United States Patent [19]

Horodysky

[11] Patent Number: 4,524,004

[45] Date of Patent: Jun. 18, 1985

[54] BORATED N-HYDROCARBYL-HYDROCARBYLENE DIAMINES AS MULTIFUNCTIONAL LUBRICANT/FUEL ADDITIVES AND COMPOSITIONS THEREOF

[75] Inventor: Andrew G. Horodysky, Cherry Hill, N.J.

[73] Assignee: Mobil Oil Corporation, New York, N.Y.

[21] Appl. No.: 546,710

[22] Filed: Oct. 28, 1983

[51] Int. Cl.[3] ..... C10M 1/54; C10M 5/28

[52] U.S. Cl. ..... 252/32.7 E; 252/49.6; 252/40.7; 252/42.1; 252/49.7

[58] Field of Search ..... 252/32.7 E, 49.6; 564/8, 9, 141, 215; 260/404.5 PA, 462 R, 413 R

[56] References Cited

U.S. PATENT DOCUMENTS

| | | | |
|---|---|---|---|
| 2,453,057 | 11/1948 | Zienty | 564/141 |
| 3,000,916 | 9/1961 | Klass et al. | 252/49.6 |
| 4,226,734 | 10/1980 | Schuster | 252/49.6 |
| 4,328,113 | 5/1982 | Horodysky et al. | 252/49.6 |

*Primary Examiner*—William R. Dixon, Jr.
*Assistant Examiner*—C. Johnson
*Attorney, Agent, or Firm*—Alexander J. McKillop; Michael G. Gilman; Howard M. Flournoy

[57] ABSTRACT

Amino-amide borates provide effective multifunctional friction-reducing and high-temperature stabilizing additives for hydrocarbyl lubricants and fuels.

20 Claims, No Drawings

BORATED N-HYDROCARBYL-HYDROCARBYLENE DIAMINES AS MULTIFUNCTIONAL LUBRICANT/FUEL ADDITIVES AND COMPOSITIONS THEREOF

BACKGROUND OF THE INVENTION

This invention is directed to multifunctional lubricant additives particularly useful as friction modifiers and oxidation inhibitors and high temperature stabilizing additives for hydrocarbyl lubricants and fuels; to compositions containing same and to means for increasing the fuel consumption of internal combustion or turbine engines. More particularly, this invention is directed to partially borated, partial carboxylic acid reaction products of N-hydrocarbylhydrocarbylene diamines and to lubricant fluids containing said partially borated compounds.

Metal surfaces of machinery or engines operating under heavy loads wherein metal slides against metal can undergo excessive wear or corrosion. Lubricants used to protect against this are prone to oxidative deterioration when subjected to elevated temperatures or when exposed to atmospheric conditions for long periods of time. Accordingly, there is a continuing need for effective multifunctional additive systems capable of effectively reducing wear, modifying frictional characteristics and reducing oxidative deterioration.

U.S. Pat. No. 3,652,410 describes multifunctional lubricant additive compositions comprising over-based metal salts and sulfur containing compounds.

U.S. Pat. No. 4,162,224 describes antiwear and antioxidant additives comprising certain borates of bis-oxazolines.

U.S. Pat. No. 4,368,129 describes multifunctional lubricant additives and compositions thereof comprising metal salts of partially borated, partially phosphosulfurized polyols and hydroxyl containing esters which are effective friction reducing and antioxidant additives when used in various lubricating media.

Amines, amine adducts, amides, and amino-amides have also found wide spread use as lubricating oil, grease and fuel additives. However, it has now been discovered that borates of alkyl diamine-carboxylic acid reaction products possess significant and highly effective friction reducing and high temperature stabilizing properties. To the best of applicant's knowledge and belief, neither the subject partially borated alkyl diamine carboxylic acid reaction products nor lubricating compositions or fuel compositions containing same were known heretofore.

SUMMARY OF THE INVENTION

In accordance with the present invention, certain partially borated, partial carboxylic acid reaction products of N-hydrocarbylhydrocarbylene diamines possess significant friction reducing and high temperature stabilizing properties which are incorporated into various lubricating fluids to which they are added. Therefore, these novel additive compounds concomitantly reduce engine wear by significantly reducing friction, provide significant improvement in high temperature stabilization and corrosion inhibition as well as enhance the detergency/dispersency characteristics of hydrocarbyl lubricants and fuels into which they are blended.

The additive compounds of the instant invention may be readily prepared from commercially available materials or the individual reactants may be prepared by any convenient means known in the art. One convenient method for preparation of the additive compound is as follows: A long chain N-hydrocarbyl-hydrocarbylene diamine having the below described generalized structure is (1) partially reacted with a suitable carboxylic acid and thereafter (2) borated. However this reaction sequence can be reversed i.e. (1) the boration is performed, then (2) the reaction with a suitable carboxylic acid is carried out. A low molecular weight formate ester having from 2 to about 6 carbon atoms can be used instead of the carboxylic acid. Thus, instead of reacting the diamine with a carboxylic acid, the same type of intermediates can be made by diamine ammonolysis of an appropriate formate ester.

$R^1$—NH—$(CH_2)_n$—$NH_2$
(1) $R^2COOH$
(2) Boration;

$R^1$—NH—$(CH_2)_n$—$NH_2$
(1) Boration
(2) $R^2COOH$;

$R^1$—NH—$(CH_2)_n$—$NH_2$
(1) Formate ester (Ammonolysis)
(2) Boration; or $R^1$—NH—$(CH_2)_n$—$NH_2$
(1) Boration
(2) Formate ester (Ammonolysis)

wherein $R^1$ is from about $C_8$ to about $C_{30}$ hydrocarbyl, $R^2$ is from about $C_1$ to about $C_{20}$ hydrocarbyl and n is 2 or 3.

Reaction times, temperatures and pressures can vary within wide limits. In a one-pot reaction, for example, temperatures can vary from about 70° to about 250° C., pressures can vary depending, inter alia, upon the ratio of reactants, etc., from ambient to higher, if desired, and reaction times can vary from about 3.5 to about 8 hours. Usually the diamine and carboxylic acid are reacted in a pot (molar) ratio of from about 3 to 1 to about 9 to 1. The formate esters and the diamine are also reacted in the same molar ratios.

The diamine intermediate can be partially borated or a stoichiometric quantity of a suitable borating agent can be used. In some cases an excess of borating agent may be desirable. Boric acid or low molecular weight trihydrocarbyl borates or mixtures of the above are typical borating agents. Metaborates can also be used. For example, when trihydrocarbyl borates such as trimethyl borate, triethyl borate or tributyl borate are utilized, the borating reaction is usually carried out at a temperature between about 70° C. and about 250° C., preferably from 100° C. to about 200° C., employing a molar ratio of the partial carboxylic acid reaction product to the boric acid or other boron compound of from about 1:1 to about 6:1. A stoichiometric amount of borating agent can be used, but an excess of up to 100% or more is often preferred. At least 0.01% boron should be incorporated into the product. The product can contain up to 3–10% boron.

As is readily apparent, there are many means of preparing the hydrocarbyl-hydrocarbylene diamines, the partial reaction products of the carboxylic acids and the partially borated adducts thereof. Any convenient means known for preparing or otherwise obtaining these compounds or any of their intermediates may be utilized.

Suitable carboxylic acids include but are not limited to formic acid, acetic acid and other relatively low molecular weight organic acids. Formic acid is preferred. Suitable amines include but are not limited to N-coco-1,3-propylenediamine, N-oleyl-1,3-propylenediamine, N-soya-1,3-propylenediamine, N-tallow-1,3-propylenediamine, N-hydrogenated Tallow-1,3-propylenediamine, N-octadecyl-1,3-propylenediamine, N-linoleyl-1,3-propylenediamine, N-dodecyl-1,3-propylenediamine, each of the above corresponding ethane diamines and mixtures of the above. Mixtures are often preferred.

Suitable lubricating media comprise oils of lubricating viscosity, mineral or synthetic, mixtures of mineral and synthetic oils, various functional oil-base fluids and solid lubricants or greases in which any of the aforementioned oils may be employed as the vehicle. Such functional fluids include hydraulic oils, brake oils, power transmission oils and the like.

In general, where mineral oils are employed as the lubricant, or grease vehicle they may be of any suitable lubricating viscosity, as for example ranging from about 45 SSU at 100° F. to about 6000 SSU at 100° F., and, preferably, from about 50 to about 250 SSU at 210° F. These oils may have viscosity indices from below zero to about 100 or higher. Viscosity indices from about 70 to about 95 are preferred. The average molecular weight of these oils may range from about 250 to about 800. Where the lubricant is to be employed in the form of a grease, the mineral and/or synthetic lubricating oil is generally employed in an amount sufficient to balance the total grease composition, after accounting for the desired quantity of the thickening agent and/or other additive components to be included in the grease formulation.

In instances where synthetic oils are the lubricant, or where synthetic oils are employed as the vehicle for a grease or other solid lubricants in preference to mineral oils, or in combination therewith, various synthetic compounds may be successfully utilized. Typical synthetic oils or vehicles include polyisobutylene, polybutenes, hydrogenated polydecenes, polypropylene glycol, polyethylene glycol, trimethylol propane esters, neopentyl and pentaerythritol esters, di(2-ethyl-hexyl)-sebacate, di(2-ethyl-hexyl)adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis(p-phenoxy phenyl) ether, phenoxy phenylethers, etc.

As indicated above, the aforementioned additive compounds can be incorporated into grease compositions. When high temperature stability is not a requirement of the finished grease, mineral oils having a viscosity of at least 40 SSU at 150° F., and particularly those falling within the range from about 60 SSU to about 6,000 SSU at 100° F. may be employed. The lubricating vehicles of the improved greases of the present invention are combined with a grease-forming quantity of a suitable thickening agent. For this purpose, a wide variety of materials may be dispersed in the lubricating vehicle in grease-forming quantities and in such degree as to impart to the resulting grease composition the desired consistency. Exemplary of the thickening agents that may be employed are non-soap thickners, such as surface-modified clays and silicas, aryl ureas, calcium complexes and similar materials. Especially included are greases thickened or containing at least a portion of alkali earth metal soap of hydroxyl-containing fatty acids, esters or glycerides when the fatty acid portion contains from 12 to about 30 carbon atoms per molecule. The metals are typified by sodium, lithium, calcium and barium. Preferred fatty materials include 12-hydroxystearic acid or esters or glycerides containing 12-hydroxystearates. In general, grease thickners may be employed which do not melt and dissolve when used at the required temperature within a particular environment. However, in all other respects, any material which is normally employed for thickening or gelling hydrocarbon fluids or forming greases can be used in preparing greases in accordance with the present invention. The fully formulated lubricant may include various dispersants, detergents, inhibitors, antioxidants, pour depressants, antiwear, antifoam, and/or other additives for their intended purposes, including phenates, sulfonates, polymeric succinimides and zinc dithiophosphates.

The additives of this invention often perform best in the presence of metallic or non-metallic dithiophosphates such as zinc dithiophosphates exemplified by the following generalized formula $$\left[ (R^3O_2)\overset{\overset{\displaystyle S}{\|}}{P} \right]_n M$$

where M is a metal such as zinc (or non-metal) and $R^3$ is $C_3$–$C_{18}$ hydrocarbyl such as propyl, butyl, pentyl, hexyl, oleyl or mixtures of these and similar hydrocarbyl groups.

The additives in accordance herewith may be incorporated into the various lubricating media in an amount from about 0.01 to about 10 wt. % and preferably from about 0.5 to 2 wt. %.

DESCRIPTION OF SPECIFIC EMBODIMENTS

The following exemplary matter serve to illustrate the additive compounds and lubricant compositions of the invention without limiting same.

EXAMPLE 1

N-Oleyl-1,3-Propylenediamine-Formic Acid-Boric Acid Reaction Product

Approximately 160 g of N-oleyl-1,3-propylenediamine (obtained commercially) and 75 g toluene were added to a 500-ml reactor equipped with agitator, heater and Dean-Stark tube with condenser and provision for blanketing vapor space with nitrogen. Approximately 26 g of 88% formic acid and then 15 g boric acid were added, and the temperature was raised to 175° C. over a period of 4½ hours until water evolution as a result of azeotropic distillation slowed. The reactants were held for 3 additional hours at 175° C. and the solvent was then removed by vacuum distillation. The product was cooled to 100° C. and filtered through diatomaceous earth.

EXAMPLE 2

N-Tallow-1,3-Propylenediamine-Formic Acid-Boric Acid Reaction Product

Approximately 160 g of N-tallow-1,3-propylenediamine (obtained commercially as Duomeen T from Armak Chemical Company) and 75 g toluene were charged to a reactor equipped as described in Example 1 and warmed to 70° C. Approximately 26 g of 88% formic acid were added, followed by the addition of 15 g boric acid. The reactants were heated to 175° C. over a period of 7 hours until water evolution ceased. The solvent was removed by vacuum distillation at 175° C. The product was cooled to 120° C. and filtered through diatomaceous earth.

The above additive compounds of this development were then separately blended into fully formulated synthetic and mineral oil-based lubricants containing polymeric dispersants, metallic phenates and sulfonates, zinc dithiophosphates and polymeric viscosity index improvers and evaluated for friction properties on the Low Velocity Friction Apparatus (LVFA).

Low Velocity Friction Apparatus (LVFA)

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces were sub-merged in the test lubricant. Friction between the steel surfaces is measured using a torque arm strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infintely variable-speed hydraulic transmission driven by a ½ HP electric motor. To vary the sliding speed, the output speed of the transmission is regulated by a lever cam-motor arrangement.

Procedure

The rubbing surfaces and 12–13 ml. of test lubricant are placed on the LVFA. A 500 psi load is applied, and the sliding speed is maintained at 40 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 40 fpm sliding speed. Freshly polished steel specimens are used for each run. The surface of the steel is parallel ground to 6 to 8 microinches. The percentages by weight are percentages by weight of the total lubricating oil composition, including the usual additive package. The data are percent decrease in friction according to:

$$\frac{(U_k \text{ of oil alone}) - (U_k \text{ of Additive plus oil})}{(U_k \text{ of oil alone})} \times 100$$

Thus, the corresponding value for the oil alone would be zero for the form of the data used in Table 1 below.

TABLE 1

Friction Properties Using Low Velocity Friction Apparatus Test

| | Concentration In Test Oil Wt. % | Percent Reduction in Coefficient of Friction 5 Ft./Min. | 30 Ft./Min. |
|---|---|---|---|
| Base Oil - Fully formulated SAE 5W-30 synthetic automotive engine oil containing detergent/dispersant/inhibitor performance package | — | 0 | 0 |
| Example 1 | 2 | 36 | 32 |
| | 1 | 27 | 29 |
| | 0.5 | 21 | 16 |
| Example 2 | 2 | 39 | 27 |
| | 1 | 30 | 25 |
| | 0.5 | 22 | 17 |

TABLE 2

Friction Properties Using Low Velocity Friction Apparatus Test

| | Concentration In Test Oil Wt. % | Percent Reduction in Coefficient of Friction 4 Ft./Min. | 30 Ft./Min. |
|---|---|---|---|
| Base Oil - Fully formulated SAE 10W-40 automotive engine oil containing detergent/dispersant/inhibitor performance package | — | 0 | 0 |
| Example 1 | 2 | 37 | 32 |

The high temperature oxidative stability properties of these additives were measured also using the Catalytic Oxidation Test at 325° as shown in Table 3. Significant control of viscosity increase, control of acidity, and lead loss by compounds in accordance with this invention was thereby demonstrated.

The test lubricant composition was subjected to a stream of air which is bubbled through the composition at a rate of 5 liters per hour at 325° F. for 40 hours. Present in the composition comprising a 200 seconds paraffinic neutral oil in addition to the additive compound were metals commonly used as materials to construct engines namely:

(a) 15.6 sq. in. of sand-blasted iron wire
(b) 0.78 sq. in. of polished copper wire;
(c) 0.87 sq. in. of polished aluminum wire; and
(d) 0.107 sq. in. of polished lead surface.

The test results are reported below in Table 3.

TABLE 3

Catalytic Oxidation Test 325° F., 40 Hours

| | Concentrate Wt. % | Neut. No. | Lead Loss mg. | Change in Viscosity Measured @ 100° C., % |
|---|---|---|---|---|
| Base Oil - 200" Solvent Paraffinic Neutral Lubricating Oil | — | 3.62 | −1.2 | 67 |
| Example 1 | 3 | 1.22 | 0.0 | 28 |
| | 1 | 0.96 | 0.0 | 5 |
| Example 2 | 1 | 1.09 | 0.2 | 1 |
| | 0.5 | 1.91 | 0.5 | 10 |

The data disclosed in Tables 1, 2 and 3 clearly demonstrate the improved characteristics imparted to lubricant compositions containing the additives described herein. Accordingly, the use of borated adducts of diamine carboxylic acid reaction products as described herein in premium quality hydrocarbyl lubricants, greases and fuels has been shown to improve the fuel economy characteristics and high temperature stabilizing properties of internal combustion engines without compromising other critical performance properties.

Preferred lubricating grease formulations can be made by including a small portion of from about 0.05% to about 4% of borated product as described above, with a small portion of from about 0.05%–4 wt. % of a phosphorodithioate in a grease thickened by an alkali or alkaline earth metal soap of hydroxyl-containing fatty materials. A preferred example is a grease prepared using 0.5% wt. of the product of Example 1, 1% of zinc O,O-dibutylphosphorodithioate, 8% of a soap thickener made from lithium 12-hydroxystearate and a mineral oil vehicle.

Although the present invention has been described with preferred embodiments, it is to be understood that modifications and variations may be resorted to without departing from the spirit and scope of this invention, as those skilled in the art will readily understand. Such variations and modifications are considered to be within the purview and scope of the appended claims.

I claim:

1. A lubricant composition comprising a major proportion of an oil of lubricating viscosity or grease prepared therefrom and a minor effective friction reducing-high temperature stabilizing amount of an additive consisting of a partially borated, partial carboxylic acid reaction product of a N-hydrocarbyl-hydrocarbylene diamine or the partially borated ammonolysis reaction product of a N-hydrocarbyl-hydrocarbylene diamine and a low molecular weight hydrocarbyl ester prepared by reacting the diamine and the carboxylic acid or ester in a molar ratio of about 3:1 to about 9:1 and borating wherein reaction conditions vary from about 3½ to 8 hours, from about 70° to 250° C. and from about ambient pressure.

2. The composition of claim 1 wherein the N-hydrocarbyl hydrocarbylene diamine has the following generalized structure $$R'NH—(CH_2)_n—NH_2$$

where $R^1$ is $C_8$ to $C_{30}$ hydrocarbyl and n is 2 or 3

3. The composition of claim 1 wherein the carboxylic acid has from about 1 to about 12 carbon atoms.

4. The composition of claim 1 wherein the additive is the reaction product N-oleyl-1,3-propylenediamene-formic acid-boric acid.

5. The composition of claim 1 wherein the additive is the reaction product N-tallow-1,3-propylenediamene-formic acid-boric acid.

6. The composition of claim 1 wherein the additive is the partially borated ammonolysis reaction product of said diamine and a low molecular $C_2$–$C_6$ hydrocarbyl ester.

7. The composition of claim 6 wherein said ester is a formate hydrocarbyl ester.

8. The composition of claim 1 wherein said oil of lubrication viscosity is selected from mineral oils or fractions thereof, synthetic oils or mixtures of mineral and synthetic oils.

9. The composition of claim 8 wherein said oil of lubricating viscosity is a mineral oil.

10. The composition of claim 9 wherein said oil of lubricating viscosity is a synthetic oil.

11. The composition of claim 1 wherein said major proportion is a grease or other solid lubricant.

12. The composition of claim 11 wherein said major proportion is a grease thickened by at least a portion of an alkali or alkaline earth metal soap of hydroxyl-containing fatty acids, esters or glycerides.

13. The composition wherein a multifunctional additive is prepared under conditions of time, temperature and pressure and ratio of reactants as described in claim 1 in accordance with the following generalized reaction $R^1—NH—(CH_2)_n—NH_2$ +
(1) $R^2COOH$
(2) Boration wherein $R^1$ is from about $C_8$ to $C_{30}$ hydrocarbyl, $R^2$ is from about $C_1$ to $C_{20}$ hydrocarbyl and n is 2 or 3 or wherein step 2 preceeds step (1).

14. The composition wherein said additive is prepared under conditions of time, temperature, pressure and molar ratio of reactants as described in claim 1 in accordance with the following generalized reaction $R^1—NH—(CH_2)_n—NH_2$ +
(1) Formate ester (Ammonolysis) and
(2) Boration wherein $R^1$ is from about $C_8$ to $C_{30}$ hydrocarbyl, and n is 2 or 3 or wherein step 2 preceeds step (1).

15. A lubricant composition as described in claim 1 containing additionally a standard additive package containing metallic or non-metallic phosphorodithioates.

16. A method for increasing of fuel consumption of internal combustion engines comprising treating the moving parts of said engines with a lubricant composition as described in claim 1.

17. A compound prepared by partially reacting a long chain N-hydrocarbyl-hydrocarbylene diamine and a carboxylic acid under conditions of time, temperature, pressure and molar ratios of reactants which vary from about 3½ hours to about 8 hours, from about 70° to 250° C., from ambient pressure and molar ratios of diamine to acid of about 3:1 to about 9:1 in the following generalized manner $$R^1—NH—(CH_2)_n—NH_2 + R^2—COOH$$

and thereafter borating the resultant product by any convenient means or first borating said N-hydrocarbyl-hydrocarbylene diamine and then reacting the borated product with said carboxylic acid and wherein $R^1$ is from about $C_8$–$C_{30}$ hydrocarbyl, $R^2$ is from about $C_1$–$C_{20}$ and n is 2–3.

18. A compound prepared by partially reacting a long chain N-hydrocarbyl-hydrocarbylene diamine and a low molecular weight formate ester under conditions of time, temperature, pressure and molar ratios of reactants which vary from about 3½ hours to about 8 hours, from temperatures of from about 70° to 250° C. from ambient pressure and molar ratios of amine to ester of from about 3:1 to about 9:1 in the following generalized manner $$R^1—NH—(CH_2)_n—NH_2 + \text{formate ester(ammonylsis)}$$

and thereafter borating the resultant product by any convenient means or first borating said N-hydrocarbyl-hydrocarbylene diamine and then reacting the resultant product with said low molecular weight formate ester wherein $R^1$ is from about $C_8$–$C_{30}$ hydrocarbyl, and n is 2–3.

19. The N-oleyl-1,3-propylenediamine-formic acid-boric acid reaction product as described in claim 17.

20. The N-tallow-1,3-propylenediamine-formic acid-boric acid reaction product as described in claim 17.

* * * * *

UNITED STATES PATENT AND TRADEMARK OFFICE

CERTIFICATE OF CORRECTION

PATENT NO. : 4,524,004

DATED : June 18, 1985

INVENTOR(S) : Andrew G. Horodysky

It is certified that error appears in the above-identified patent and that said Letters Patent is hereby corrected as shown below:

Column 6, line 28 (Table 2) heading "4 Ft/" should -- 5 Ft/ --.

Signed and Sealed this

*Seventh* Day of *January 1986*

[SEAL]

*Attest:*

DONALD J. QUIGG

*Attesting Officer*

*Commissioner of Patents and Trademarks*